United States Patent [19]

Onofrio

[11] Patent Number: 4,724,731

[45] Date of Patent: Feb. 16, 1988

[54] LAG DRIVER

[76] Inventor: Daniel J. Onofrio, 116 Ayers Rd., South Windsor, Conn. 06074

[21] Appl. No.: 820,535

[22] Filed: Jan. 17, 1986

[51] Int. Cl.[4] ..... B25B 13/02

[52] U.S. Cl. ..... 81/119; 81/124.2

[58] Field of Search ..... 81/124.1, 125, 119, 81/120, 121.1, 64, 90.1, 90.3, 90.9; 279/41–45

[56] References Cited

U.S. PATENT DOCUMENTS 2,634,775 4/1953 Unsinger ..... 279/42

3,901,298 8/1975 Eby ..... 81/125

*Primary Examiner*—Frederick R. Schmidt

*Assistant Examiner*—Maurina Rachuba

*Attorney, Agent, or Firm*—Lawrence Hager

[57] ABSTRACT

A driver for threaded fasteners, such as for an eye lag, acoustical lag and a flattened end lag screw and the like, employing a hex shank for positive chucking, a collared and chamfered tool end for precise lag alignment, and a scallop in the hex shank.

5 Claims, 7 Drawing Figures

LAG DRIVER

FIELD OF THE INVENTION

The present invention relates to driving tools and, more particularly, to a lag driver having a bifurcated inner alignment and torque member and an outer sleeve member.

BACKGROUND OF THE INVENTION

There are presently available drivers for threaded fasteners, such as for screws and the like. For example, U.S. Pat. No. 3,392,767 issued July 16, 1968 to George B. Stillwagon, Jr., describes a permanent magnet driver employing an annular band or strip of thickness-oriented magnetized rubber bonded barium ferrite disposed within or in surrounding relation to the driver.

Another prior art device, described in U.S. Pat. No. 3,024,682 issued Mar. 13, 1962 to Lewis C. Finkle, describes a tool or attachment which may be used as a nut runner for tightening nuts and the like.

Another prior art device, described in U.S. Pat. No. 985,087 issued Feb. 21, 1911 to Charles M. Wilson, appears to describe a bit having a free end provided with a recess having a curved wall to accommodate different sizes of screw-eyes.

Another prior art device, described in U.S. Pat. No. 882,937 issued Mar. 24, 1908 to Thomas J. Fegley, appears to describe a screw eye driver having a slotted head (c) for the reception of the eye portion of the screw eye. As can be clearly seen from FIGS. 1, 3, and 7, the circular portion (n) of the screw eye is retained within the slotted head substantially between the upper (not reinforced) bifurcated arm portions of the head portion (c). Thus, with the screw eye being screw into, for example, hard wood, the upper bifurcated arm portions may bend or break.

Other prior art patents of interest are U.S. Pat. No. 2,437,762 issued Mar. 16, 1948 to Louis Simonin and Offenlegungsschrift DE No. 3223109A1.

The obvious disadvantages of these prior art devices are: (1) positive lag alignment is not achieved, (2) the devices do not utilize a reinforcing sleeve over the length of the bifurcated arm, (3) the fastening devices are not securely held to enable driving into hard wood etc., (4) the tools are relatively expensive and/or sumptuous in constituent components.

These patents are mentioned as being representative of the prior art and other pertinent references may exist. None of the above cited patents are deemed to affect the patentability of the present claimed invention.

The present invention involves a novel combination of features combined in such a way to afford a solution to the difficulties and disadvantages of the prior art devices.

For example, in contrast to the prior art, the present invention provides a single purpose tool for flattened end lag screws to facilitate driving into, for example, hard wood etc., while substantially reducing lag wobble. Each tool attachment or lag driver is designed to accommodate a selected sized fastener having a flattened end lag configuration. The lag driver has a hex shank with a circumferential detent to enable utilization in a typical screwgun tool and improved clamping in a drill chuck, a slotted end or bifurcated arm members each with a chamfer on a semicircular notch extending from the free end downwardly a predetermined partial portion of each arm to substantially improve positive alignment of the screw or shank portion of the lag. In addition, a discrete sleeve is force fitted about said bifurcated arm members to reinforce said arm members to substantially prevent spreading or breaking thereof, and to substantially prevent lag slippage, thereby, enabling driving the lag into hard wood etc. without pre-drilling. The present invention provides a device having a robust and relatively inexpensive structure, enables manipulation, is adapted for ease of use and involves a minimum of associated parts.

SUMMARY OF THE INVENTION

A lag driver or attachment tool having particular utility for driving and unscrewing a flattened end lag, comprising:

a discrete tool body member having a hex shaped shaft, and a lag driving portion, and an intermediate contoured portion, said shaft having an intermediate portion of smaller diameter or circumferential detent, said lag driving portion comprises a pair of spaced apart arms each having a rounded exterior portion and a flat inner portion with an elongate semicircular notch or alcove extending a predetermined distance along the length of said arms;

a discrete tube shaped collar or sleeve member dimensioned for being force fitted about the rounded exterior portions of said arms and extending approximately from the free ends of said arms to a predetermined portion of said body member below the arm members of said lag driving portion.

Accordingly, it is an object of the present invention to provide a new and improved lag driver.

Another object of the present invention is to provide a lag driver having a two piece construction.

Another object of the present invention is to provide a lag driver having a hex shaft with an intermediate detent to facilitate use with a screwgun tool and a drill.

Another object of the present invention is to provide a lag driver having a reinforcing sleeve member.

Another object of the present invention is to provide a lag driver having a slotted end, with each arm formed by the slot having a notch to accommodate a portion of the shaft of a lag screw.

Another object of the present invention is to provide a lag driver having a contoured intermediate portion to strengthen the tool member.

Another object of the present invention is to provide a lag driver providing improved lag alignment.

Another object of the present invention is to provide a driver tool attachment for a flattened end lag screw or acoustical lag.

Another object of the present invention is to provide a lag driver having substantially less wobble than prior art drivers.

Another object of the present invention is to provide a lag driver having a chamfer to provide positive screw alignment and a collar to further secure the concentric alignment of the lag screw.

BRIEF DESCRIPTION OF THE DRAWINGS

Other objects and advantages of the invention may be more clearly seen when viewed in conjunction with the accompanying drawings. Similar reference numerals refer to similar parts throughout.

DESCRIPTION OF THE PREFERRED EMBODIMENT

Figure 1:
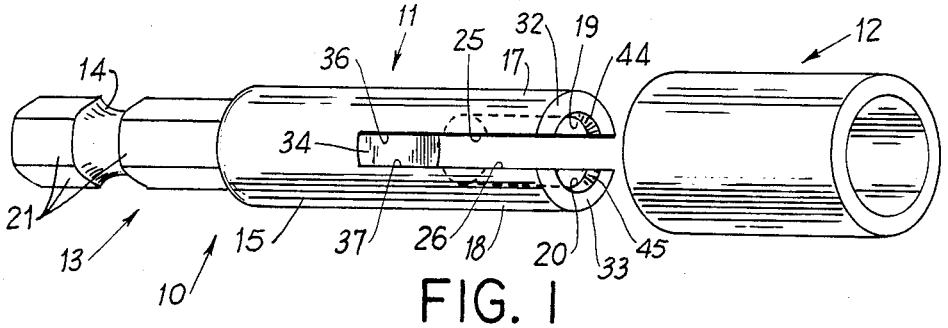
FIG. 1 is an exploded perspective view of the lag driver in accordance with the invention.
Figure 2:
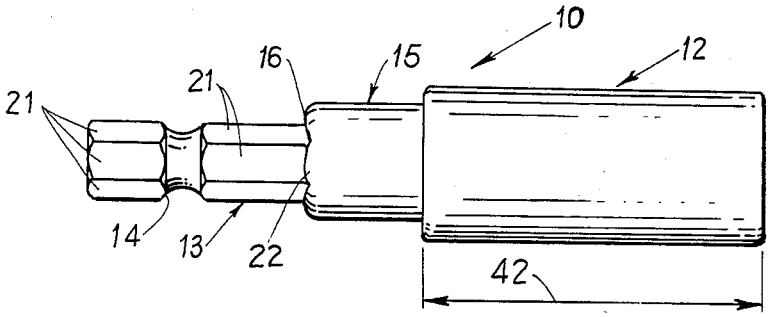
FIG. 2 is a side view of the assembled lag driver in accordance with the invention.
Figure 3:
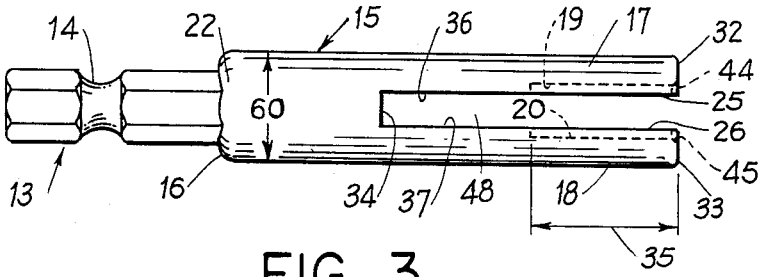
FIG. 3 is a side view, partly in phantom outline, of the inner driver member of the lag driver shown in FIGS. 1 and 2.
Figure 4:
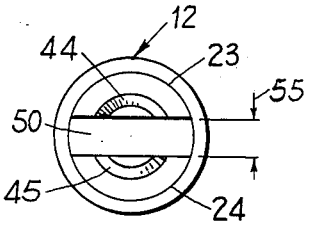
FIG. 4 is an end view of the lag driver shown in FIG. 2.
Figure 5:
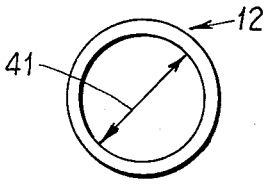
FIG. 5 is an end view of the collar member shown in FIG. 1.
Figure 6:
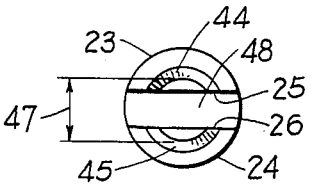
FIG. 6 is an end view of the inner driver member shown in FIG. 3.
Figure 7:
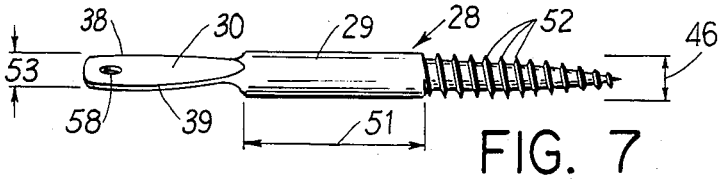
FIG. 7 is a perspective view of a typical lag screw.

Referring to the drawings, particularly FIGS. 1–8, there is shown a lag driver 10 constructed in accordance with the invention to have a two piece simple robust construction comprising a body member 11 and an outer sleeve member 12. The body member 11 and outer sleeve 12 may be formed, for example, stainless steel or zinc or zinc plus yellow dischromate or hot dip galvanized or other suitable material.

The body member 11 comprises a hex shaped shaft 13 having an intermediate portion or detent 14, a body portion 15, a contoured or tapered portion 16, a pair of spaced apart arm members 17 and 18, and a pair of aligned shaft receiving alcoves or semicircular troughs 19 and 20.

The shaft 13 is dimensioned for being readily insertable into a chuck of an electric type drill (not shown) or a conventional type screwgun (not shown). Shaft 13 has a plurality of flattened surfaces 21 to enhance gripping or locking of shaft 13 in the drill chuck and, thereby, substantially prevent rotational slippage of shaft 13 relative to the drill chuck. Although the flattened surfaces 21, in accordance with the preferred embodiment of the invention, defines an elongate hexagonal shaped shaft 13, it should be appreciated that other configurations may be utilized. The circumferential detent 14 may be provided to facilitate lag driver 10 engagement in, for example, a so called screwgun (not shown) with a spring loaded ball mechanism. Thus, detent 14 is dimensioned, disposed and configured to accommodate a portion of the spring loaded ball of a screwgun or like device with said shaft 13 being inserted into its shaft or bit mounting aperture. The dimension of shaft 13 and detent 14 may be empirically determined to for matting with conventional drill chucks and screwguns.

The intermediate body portion 15 has a round configuration and length of predetermined dimension to accommodate sleeve 12 as will be discussed in greater detail hereinafter.

Contoured or sloped wall portions 16 may be provided between the upper end 22 of shaft 13 and body portion 15. Applicant has determined that such contouring or slopping of wall portions 16 provides improved strength and generally reduces the possibility of the shaft 13 breaking at or about its upper end 22 juxtaposed to sloped wall portions 16, relative to a normal, i.e., 90 degree, junction line. In this manner, improved reliability and torque strength is provided.

Arms 17 and 18 each have a semicircular outer surface 23 and 24 configuration with a generally flat inner surface 25 and 26, respectively. Each arm 17 and 18 has a predetermined length and dimension, and are spaced apart a distance 27, to accommodate a flat portion 30 of lag screw 28 as will be more fully discussed hereinafter. Each arm 17 and 18 has an elongate chamfer or semicircular trough 19 and 20, respectively, dimensioned for receiving there between a round bolt shaped shaft portion 29 of lag screw 28. It should be noted at this time that the chamfer 19 and 20 does not extend the entire length of arms 17 and 18, but rather extend from their free ends 32 and 33 partially downwardly toward ledge 32 a predetermined distance 35. In this manner, the inner or lower portions 36 and 37 of arms 17 and 18, respectively, are not chamfered to improve their strength and provide improved engagement with the edges 38 and 39 of the flattened head 30 portion of lag screw 28, during screwing and unscrewing thereof with a support beam (not shown) and the like. Applicant has discovered that with such chamfering, improved lag driver 10 strength and lag alignment is generally achieved. The dimension of arms 17, 18 and chamfers 19, 20 may be empirically determined to accommodate a desired sized lag screw. The free ends 32 and 33 of arms 17 and 18 may be inwardly beveled 44 and 45 about chamfers 19 and 20, respectively, to facilitate insertion of the lag screw 28 between arms 17 and 18.

It should be noted that the inner flat sections 25 and 26, 36 and 37 are spaced apart a distance less than the diameter 46 of lag screw 28. Thus, only the flat head portion 30 of lag screw 28 is capable of being disposed between lower arm portions 36 and 37. The diameter 47 defined by chamfers 19 and 20 and space 48 is designed to be slightly greater than the diameter 46 of bolt portion 29 of lag screw 28. In this manner, with lag screw 28 inserted into lag driver 10, the flat head portion 30 extends inwardly or downwardly between surfaces 36 and 37 of arm 17 and 18, and a portion of the bolt section 29 of lag screw 28 is received between chamfers 19 and 20.

From the above, it should be appreciated that lag driver 10 is dimensioned to accommodate a specific sized lag screw and that different sized lag drivers may be provided for different sized lag screws. It being recognized that the dimensions of the lag driver 10 are determined or selected to constrain the lag screw in substantially longitudinal/axial alignment with lag driver 10.

Collar or sleeve 12 has an elongate tube or pipe shape with an inner diameter 41 dimensioned for being force fitted about a portion of body member 11. Collar 12 has a predetermined length 42 such that it extends approximately from the free ends 32 and 33 of arms 17 and 18, respectively, downwardly about a portion of the intermediate body section 15 of body member 11. In this manner, arms 17 and 18 are reinforced or substantially prevented from being outwardly bent apart under pressure from a lag screw driving operation or the like.

OPERATION

With particular reference now to FIGS. 1, 3, 4 and 7, the operation, function and additional structural and functional features of the present invention will be described.

A lag screw 28 (shown partly in phantom outline) is inserted into slot or opening 50 of the assembled lag driver 10 (see FIG. 2), such that flat head 30 extends below chamfer 19 and 20, with its flat surfaces being juxtaposed with a respective flat arm portion 36 and 37. With lag screw 28 inserted as such into slot 50, lag screw 28 is substantially axially aligned with lag driver 10 and bolt section 29 being constrained between chamfers 19 and 20. As noted above, the diameter 47 of semicircular chamfers 19 and 20 is slightly greater than the diameter 46 of bolt section 29 of lag screw 28. The length 51 of bolt section 29 is generally equal to or greater than the length 35 of chamfers 19 and 20, whereby the screw treads 52 project outwardly from lag driver 10. Generally, the width 53 of flat head 30 is less than the elongate distance 54 of slot 50 and greater than the diameter 47 and greater than the spacing 55 between arms 17 and 18, such that edges 38 and 39 abut against a respective flat wall portion 36 and 37 of arms 17 and 18 to prevent rotation of lag screw 28 relative to lag driver 10.

Assuming that hex shaft 13 is secured in a screwgun or drill chuck (not shown), lag screw 28 can then be screwed into a wood beam etc.

It should be appreciated that since arm 17 and 18 are prevented from being bent apart due to the constraining effect of collar 12, lag screw 28 is substantially maintained and constrained in axial alignment with lag driver 10. The rotational driving force, via the drill or screwgun, is imparted to lag driver 10 which, in turn, with engagement of walls 36 and 37 against a respective portion of lag screw flat head 30, generally at edges 38 and 39, lag screw 28 is caused to rotate coincidentally with lag driver 10. Since collar 12 encircles and reinforces the not chamfered wall portions 36 and 37 of arms 17 and 18, relatively greater driving force than heretofore possible can be applied by lag driver 10 to lag screw 28 without bending or breaking arms 17 and 18, and without lag screw 28 becoming misaligned in lag driver 10. In this manner, a lag screw 28 may be driven into hard woods generally without the need for pre-drilling a hole therein to receive said lag screw. Thus, substantially time and, therefore, labor cost may be realized in the installation, for example, of dropped or acoustical ceilings which utilize such lag screws, i.e., wire through eye hole 58 and affixed to the suspended ceiling support beams, to support such ceiling to the building structure.

While there has been shown what is considered to be the preferred embodiment of the invention, it is desired to secure in the appended claims all modifications as fall within the spirit and scope of the invention.

I claim:

1. A lag driver tool mountable in a drill chuck and screwgun to facilitate driving a lag screw having a flattened head member and an intermediate round shaft portion and a screw thread end portion, comprising:

a driver means (11) having a shaft member (13), a body portion (15), and a pair of spaced apart arm members (17,18), said shaft member having one or more flat portions (21) to facilitate said shaft member being secured in the drill chuck, said body portion having a round exterior surface with a lower taper portion (16) extending into said shaft member to enhance junction strength between said shaft member and said body portion, said arm members each projecting from a ledge portion (34) a predetermined arm length and having a round exterior surface (23,24) and having an elongate semicircular shaped chamfer (19, 20) with a predetermined chamfer length (35) approximately equal to or less than the length (51) of the intermediate round shaft portion of the lag screw and having a lowe flat leg screw head engagement section (36,37) and being spaced apart a distance (47,55) to define a lag receiving slot 50 dimensioned for receiving a portion of the lag screw (28) with its flattened head member being juxtapositioned between said lag screw head engagement sections (36,37) and a portion of its shaft portion (29) being substantially laterally constrained between said chamfers (19,20); and a collar means (12) having a hollow elongate cylinder configuration with wall portions defining an inner diameter (41) and having a predetermined collar length (42), said inner diameter being approximately equal to or greater than the exterior diameter (60) of said body portion (15), said collar length being approximately equal to or greater than the length of said arm members, said collar means being force fitted about a portion of said arm members to constrain said arm members.

2. A lag driver attachment tool as in claim 1, wherein: the driver member has an elongate hexagonal shape with an intermediate detent.

3. A lag driver attachment tool as in claim 1, wherein: the intermediate body portion is contoured to said shaft portion to enhance structural strength of the lag driver attachment tool.

4. A lag driver attachment tool as in claim 1, wherein: the space between said arm members is greater than the thickness of the flattened end of the lag screw and less than the width of the flattened end of the lag screw.

5. A lag driver attachment tool as in claim 1, wherein: portions of the wall sections of each arm member being spaced apart and aligned and dimensioned so that said lag screw mounting slot has an effective diameter slightly greater than the diameter of the lag screw.

* * * * *